US006679242B1

(12) United States Patent
Martin

(10) Patent No.: US 6,679,242 B1
(45) Date of Patent: Jan. 20, 2004

(54) ARCHERY BOWSTRING ACCESSORY AND METHOD OF INCREASING ARROW SPEED AND REDUCING BOWSTRING VIBRATION IN SHOOTING AN ARROW FROM AN ARCHERY BOW

(75) Inventor: Ryan Gail Martin, Walla Walla, WA (US)

(73) Assignee: Martin Archery, Inc., Walla Walla, WA (US)

( * ) Notice: Subject to any disclaimer, the term of this patent is extended or adjusted under 35 U.S.C. 154(b) by 0 days.

(21) Appl. No.: 10/338,159

(22) Filed: Jan. 7, 2003

(51) Int. Cl.[7] ..... F41B 5/20
(52) U.S. Cl. ..... 124/90
(58) Field of Search ..... 124/90, 92, 86, 124/23.1

(56) References Cited

U.S. PATENT DOCUMENTS

| | | | | |
|---|---|---|---|---|
| 3,756,214 A | | 9/1973 | Christen | 124/23 |
| 3,837,327 A | | 9/1974 | Saunders et al. | 124/30 A |
| 3,969,825 A | * | 7/1976 | Mathes | 33/506 |
| 4,023,551 A | | 5/1977 | Huddleston | 124/92 |
| 4,080,951 A | | 3/1978 | Bateman, III | 124/2 |
| 5,016,604 A | | 5/1991 | Tilby | 124/92 |
| 5,362,046 A | | 11/1994 | Sims | 273/73 |
| 5,979,427 A | * | 11/1999 | Chalin et al. | 124/87 |
| 6,237,584 B1 | | 5/2001 | Sims | 124/92 |

* cited by examiner

*Primary Examiner*—Jacob K. Ackun
(74) *Attorney, Agent, or Firm*—Wells St. John P.S.

(57) ABSTRACT

An archery bowstring accessory includes a unitary longitudinally elongated body having a head end portion, a tail end portion, and an intermediate section extending therebetween. The intermediate section is configured to extend longitudinally along a bowstring in an orientation which configures the head end portion more proximate a limb end of a bow which receives said bowstring than is the tail end portion. As so received, the head end portion constitutes a speed increasing mass effective to impart increased arrow speed in an arrow shot by said bowstring of said bow than would otherwise occur in an identical arrow shot in the absence of the speed increasing mass. As so received, the tail end portion constitutes a vibration dampening mass effective to impart reduced bowstring vibration in said arrow shot than would otherwise occur in said identical arrow shot in the absence of said vibration dampening mass. Methods are disclosed.

68 Claims, 4 Drawing Sheets

ARCHERY BOWSTRING ACCESSORY AND METHOD OF INCREASING ARROW SPEED AND REDUCING BOWSTRING VIBRATION IN SHOOTING AN ARROW FROM AN ARCHERY BOW

TECHNICAL FIELD

This invention relates to arrow speed and bowstring vibration, and to archery bowstring accessories.

BACKGROUND OF THE INVENTION

When shooting an arrow with an archery bow, the bowstring will typically vibrate and make noise when the arrow is released. This can adversely affect the archer's arrow shot or, when hunting, alert game in sufficient time to move and avoid being hit, or hit in a location other than where the archer intended by an otherwise well aimed and executed shot. A variety of vibration dampening and noise reducing accessories for bowstrings have been proposed, for example as described in U.S. Pat. Nos. 6,237,584; 5,362,046; 5,016,604; 4,080,951; 4,023,551; 3,837,327; and 3,756,214, to name just a few.

One drawback with typical silencers is that their construction and positioning on the bowstring, while dampening vibration and reducing noise, does tend towards reducing the speed of the arrow. Devices commercially known as "speed buttons", when connected to a bowstring, can have the alternate effect of increasing the arrow speed.

SUMMARY

The invention includes an archery bowstring accessory and method of increasing arrow speed and reducing bowstring vibration in shooting an arrow from an archery bow. In one implementation, an archery bowstring accessory includes a unitary longitudinally elongated body comprising a head end portion, a tail end portion, and an intermediate section extending between the head end portion and the tail end portion. The intermediate section is configured to extend longitudinally along a bowstring in an orientation which configures the head end portion more proximate a limb end of a bow which receives said bowstring than is the tail end portion. As so received, the head end portion constitutes a speed increasing mass effective to impart increased arrow speed in an arrow shot by said bowstring of said bow than would otherwise occur in an identical arrow shot in the absence of the speed increasing mass. As so received, the tail end portion constitutes a vibration dampening mass effective to impart reduced bowstring vibration in said arrow shot than would otherwise occur in said identical arrow shot in the absence of said vibration dampening mass.

In one implementation, a method of increasing arrow speed and reducing bowstring vibration in shooting an arrow from an archery bow includes providing a unitary longitudinally elongated body comprising a head end portion, a tail end portion, and an intermediate section extending between the head end portion and the tail end portion. The body is secured to a bowstring operably received by an archery bow with the intermediate section extending longitudinally along and against the bowstring with the head end portion being received more proximate a limb end of the bow than is the tail end portion As so secured, the head end portion constitutes a speed increasing mass effective to impart increased arrow speed in an arrow shot by said bowstring of said bow than would otherwise occur in an identical arrow shot in the absence of the speed increasing mass. As so secured, the tail end portion constitutes a vibration dampening mass effective to impart reduced bowstring vibration in said arrow shot than would otherwise occur in said identical arrow shot in the absence of said vibration dampening mass. The arrow shot having increased arrow speed and reduced bowstring vibration is then effected by shooting an arrow with the bow.

Other aspects and implementations are contemplated.

BRIEF DESCRIPTION OF THE DRAWINGS

Preferred embodiments of the invention are described below with reference to the following accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
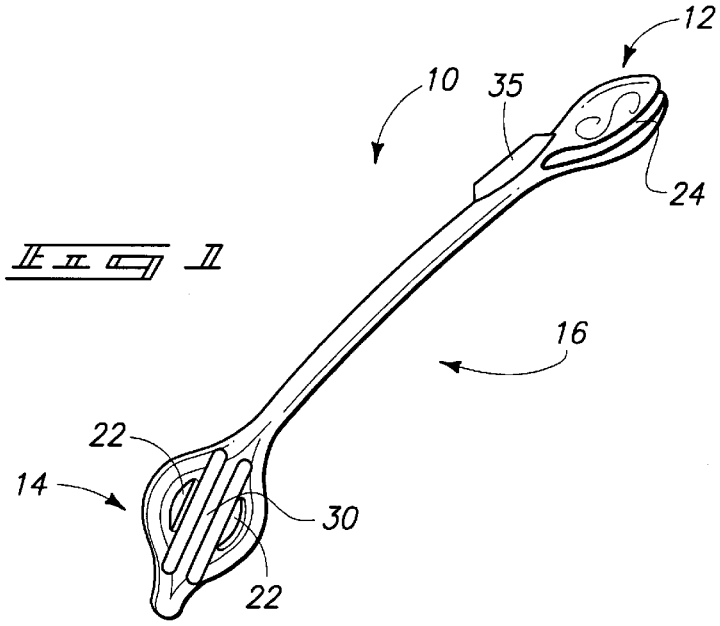
FIG. 1 is a diagrammatic perspective view of an archery bowstring accessory in accordance with one implementation of aspects of the invention.
Figure 2:
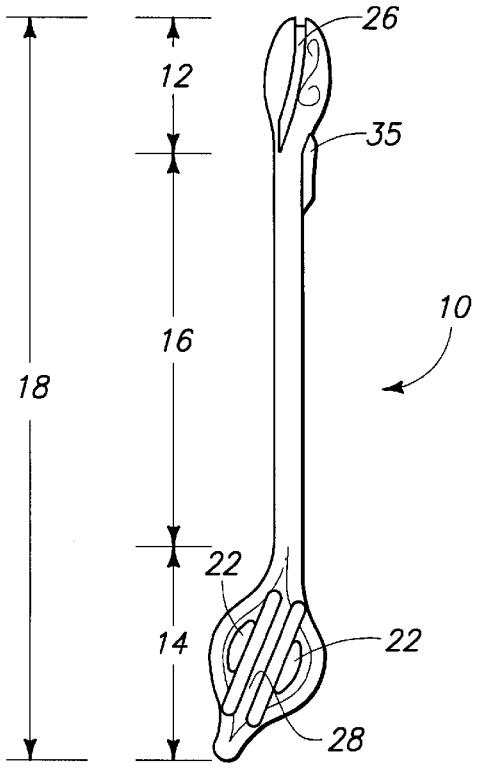
FIG. 2 is a side elevational view of the FIG. 1 accessory.
Figure 3:
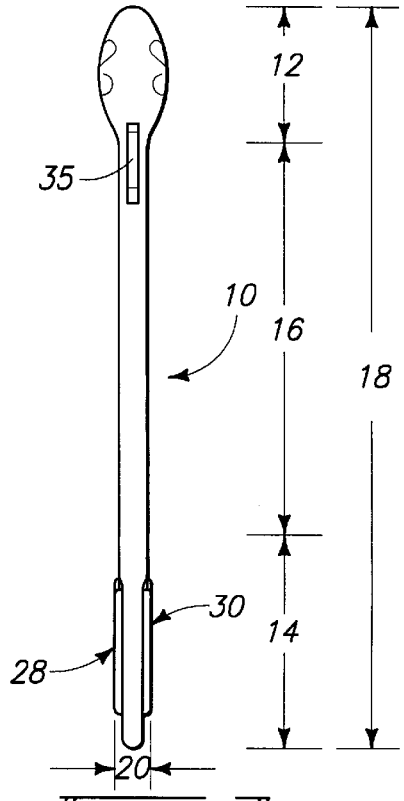
FIG. 3 is a top down view of the FIG. 1 accessory.

In accordance with a most preferred aspect of the invention, an archery bowstring accessory is described initially with reference to FIGS. 1–3. The archery bowstring accessory includes a unitary longitudinally elongated body 10 comprising a head end portion 12, a tail end portion 14, and an intermediate section 16 extending between head end portion 12 and tail end portion 14. In one preferred embodiment, body 10 is preferably homogenous in composition and comprised of an elastomeric material. One exemplary preferred material is a soft, amorphous, rubber-like material, with Dynaflex G-6713 being a specific example, and which is available from GLS Corporation of McHennery, Ill. Preferably, body 10 has an unstressed, unstretched, longest length 18, as shown, of at least 4.0 inches. One specific example is a length 18 of about 4.5 inches. Intermediate section 16 is configured to extend longitudinally along a bowstring in an orientation which configures the head end portion more proximate a limb end of a bow which receives the bowstring than is the tail end portion. As used herein, the terms "head end portion" and "tail end portion" refer only to the orientation of the accessory as configured to be received on an archery bow in such relative positioning as herein stated regardless of any head-like or tail-like appearance of the accessory.

As so received on a bowstring, the head end portion constitutes a speed increasing mass effective to impart increased arrow speed in an arrow shot by the bowstring of the bow than would otherwise occur in an identical arrow shot in the absence of the speed increasing mass. Further as so received, the tail end portion constitutes a vibration dampening mass effective to impart reduced bowstring vibration in the arrow shot than would otherwise occur from the identical arrow shot in the absence of the vibration dampening mass. The inventor is not aware of anyone who has combined a speed increasing function in an archery bowstring accessory with a vibration dampening function, and it would not be obvious to do so as archery bowstring accessories that reduce vibration are also known to decrease speed.

In one preferred embodiment, the speed increasing mass of head end portion 12 is greater than the vibration dampening mass of tail end portion 14. Further in one preferred embodiment, the intermediate section has a mass which is less than each of the speed increasing mass and the vibration dampening mass. By way of example only, in one preferred embodiment where the illustrated body 10 is homogenous and made of the Dynaflex G-6713 material and approximately 4.5 inches long, an overall weight of body 10 is 42.6 grains, with head end portion 12 being approximately 15.8 grains, tail end portion 14 being approximately 14.3 grains, and intermediate section 16 being 12.5 grains.

In the illustrated preferred embodiment, intermediate section 16 has a substantially constant cross-sectional shape along at least a majority of its length, with the exemplary preferred such shape being circular. Also in the illustrated preferred embodiment, head end portion 12 and tail end portion 14 are radially enlarged as compared to intermediate section 16, and are so enlarged to different degrees as compared to intermediate section 16. Further in the illustrated preferred embodiment, tail end portion 14 is angled from a general longitudinally elongated orientation of the body, for example angled slightly relative to the illustrated length line 18. In one preferred embodiment, tail end portion 14 also has a degree of flatness which is greater than any degree of flatness of head end portion 12. For example, FIG. 3 depicts tail end portion 14 having a thinnest/flattest dimension 20 that is less than the largest corresponding dimension of head end portion 12 in either of FIGS. 2 and 3. Tail end portion 14 also has a pair of orifices 22 extending therethrough. One of more orifices might be provided in any one or combination of tail end portion 14, intermediate section 16, and head end portion 12.

Head end portion 12 includes a pair of opposing external longitudinal grooves 26 and 24. Tail end portion 14 also includes a pair of opposing external longitudinal grooves 28 and 30. Such grooves are ideally sized and otherwise configured to receive respective portions of a split bowstring, as will be more clear from the continuing discussion. In the illustrated and ornamental embodiment, head end portion 12 is provided with a pair of raised eyes, with grooves 24 and 26 creating a mouth-like appearance, and an ornamental fin 35 is also provided to produce an exemplary lizard-like look. Any other or non-ornamental/marketing-like appearances could be utilized, or not at all, of course.

Figure 4:
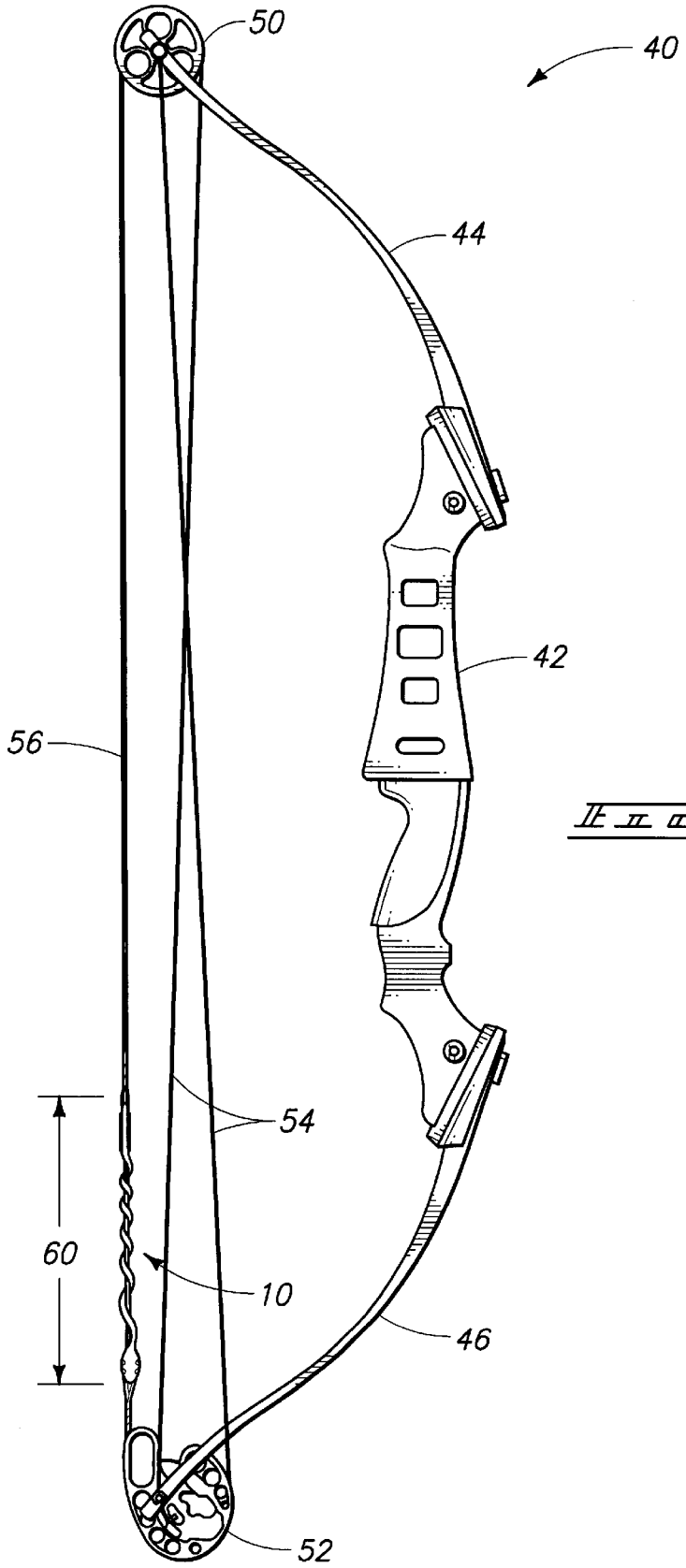
FIG. 4 is a perspective view of an archery bow incorporating the FIG. 1 accessory.
Figure 5:
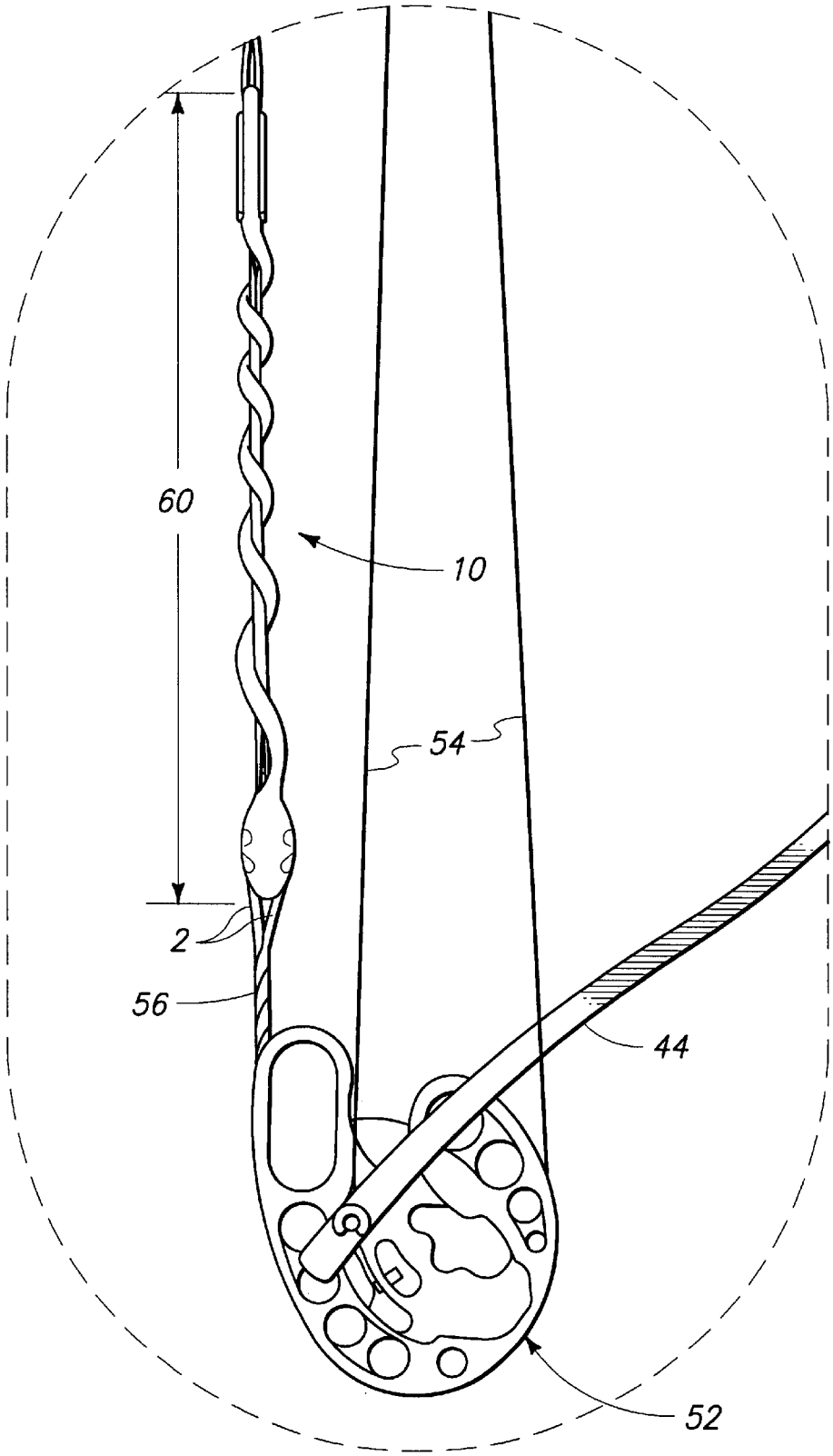
FIG. 5 is an enlarged view of a portion of FIG. 4 showing the accessory retained by the bowstring of the bow.

FIGS. 4 and 5 depict the archery bowstring accessory of FIGS. 1–3 received by an archery bow 40. Any conventional or yet-to-be developed archery bow is contemplated, of course, with bow 40 comprising a compound bow. Exemplary bow 40 includes a handle portion 42. Limbs 44 and 46 connect with and extend from handle portion 42. Wheels 50 and 52 are secured at the ends of bow limbs 44 and. 46, respectively, with at least one being mounted eccentrically to provide a compound bow effect. Cables 54 are secured to the ends of the bow limbs and wrap around wheels 50 and 52, extending to a bowstring 56 which is thereby operably received for shooting an arrow. Body 10 is shown received by bowstring 56 proximate limb 46. Of course alternately or in addition thereto, a body/device 10 could also be received at the upper portion of the bow proximate limb 44.

The invention also contemplates methods of increasing arrow speed and reducing bowstring vibration in shooting an arrow from an archery bow. Such method includes providing a unitary longitudinally elongated body comprising a head end portion, a tail end portion, and an intermediate section extending between the head end portion and the tail end portion. Body 10 of FIGS. 1–3 is but one exemplary example. In the illustrated preferred embodiment, body 10 is secured to bowstring 56 with intermediate section 16 extending longitudinally along and against bowstring 56 with head end portion 12 being received more proximate the outer end of limb 44 than is tail end portion 14. In the depicted preferred embodiment, the securing includes wrapping the intermediate section longitudinally around bowstring 56, preferably at least five times. Alternately by way of example only, intermediate section 16 could wrap less than five times or not at all, and merely extend in contacting or non-contacting/spaced adjacent relationship between head end portion 12 and tail end portion 14 relative to bowstring 56. However, most preferred is the depicted FIGS. 4 and 5 configuration. Using a preferred elastomeric material, body 10 is preferably retained relative to bowstring 56 in a stretched state having a body length 60 which is greater than the unstressed, unstretched body length/state 18 (FIGS. 1–3). The degree of any preferred stretch and the positioning of body 10 relative to bowstring 56 between the ends of limbs 44 and 46 can be optimized and selected by the archer. In one exemplary embodiment, stretched body length 60 is just slightly less than 6 inches, and the end of head end portion 12 from the outside race or track of wheel 52 is approximately 1.5 inches.

In one preferred embodiment and as shown, head end portion 12 and tail end portion 14 as respectively so secured are received against (in contacting relationship with) bowstring 56. Alternately but less preferred, one or both of such end portions might not be received against bowstring 56. In the illustrated preferred embodiment and in one intended use, bowstring 56 is splittable and the securing of the body to the bowstring includes positioning head end portion 12 within the split bowstring, and with the split bowstring being received within grooves 24 and 26. Likewise in the illustrated and preferred embodiment, the securing preferably includes positioning tail end portion 14 within split bowstring 56 such that the split bowstring is also received within grooves 28 and 30. Alternately and less preferred, one or both of the illustrated or other head and tail end portions might be secured differently, for example and by way of example only by tieing relative to bowstring 56.

Also in methodical aspects of the invention, as the body is secured to the bowstring, the head end portion constitutes a speed increasing mass effective to impart increased arrow speed in an arrow shot by the bowstring of the bow than would otherwise occur in an identical arrow shot in the absence of the speed increasing mass. Further as so secured, the tail end portion constitutes a vibration dampening mass effective to impart reduced bowstring vibration in the arrow shot that would otherwise occur from an identical arrow shot in the absence of the vibration dampening mass. Thus also in accordance with methodical aspects of the invention, the method of increasing arrow speed and reducing bowstring vibration also includes shooting an arrow having increased arrow speed and reduced bowstring vibration, thereby affecting the arrow shot.

Figure 6:
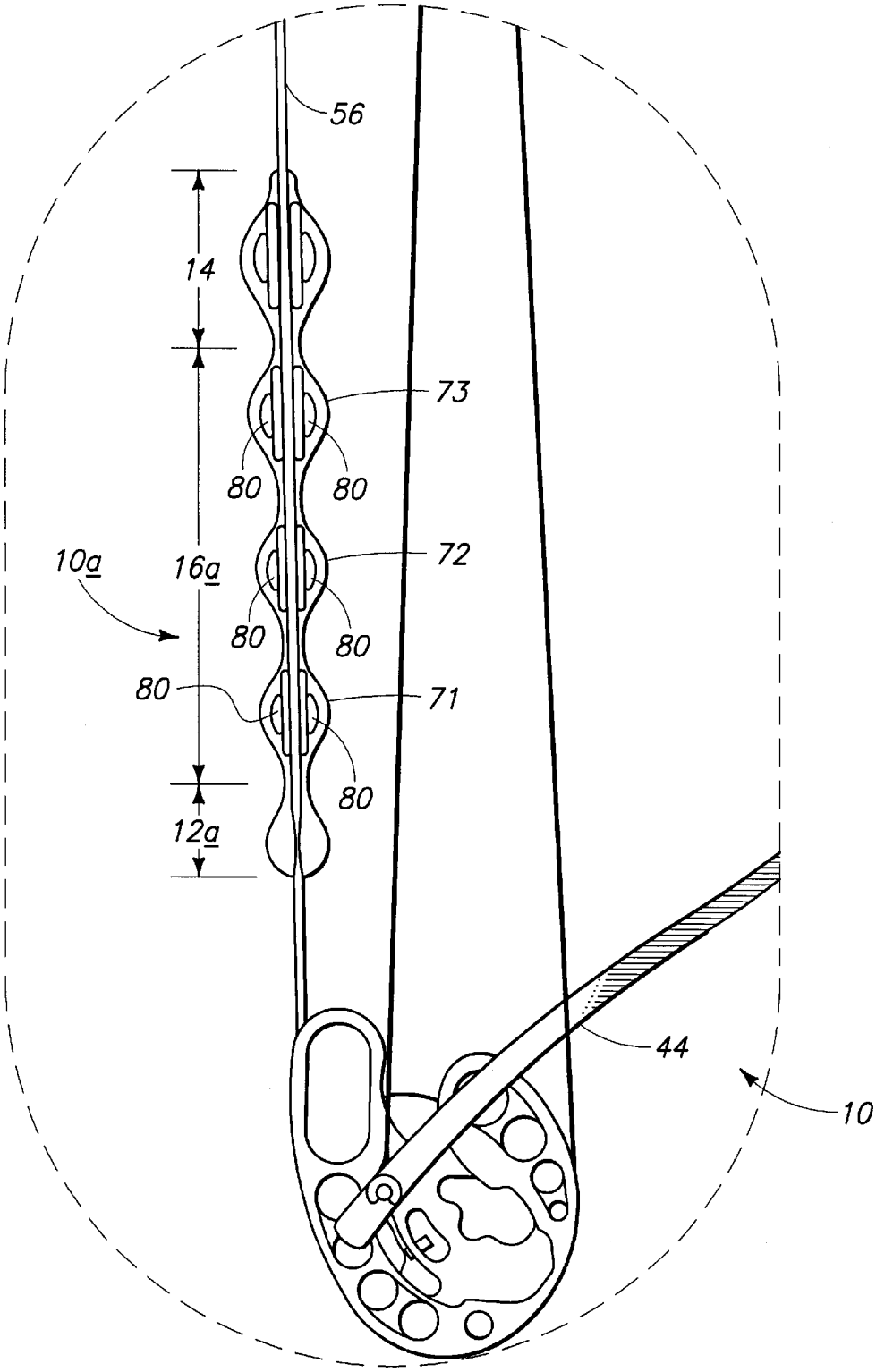
FIG. 6 corresponds to the FIG. 5 view but showing an alternate embodiment accessory in accordance with an aspect of the invention.

By way of example only, an alternate exemplary embodiment is depicted in FIG. 6. Like numerals from the first described embodiment are utilized where appropriate, with differences being indicated with the suffix "a" or with different numerals. Unitary longitudinally elongated body **10*a* comprises a head end portion 12*a*, an intermediate section 16***a*, and a tail end portion 14. In this particular exemplary embodiment, intermediate section 16*a* does not have a substantially constant cross-sectional shape along a majority of its length. Intermediate section 16*a* is depicted as having a plurality of spaced radially enlarged masses 71, 72 and 73, with the size and mass of each increasing in going from 71 to 73. Radially enlarged masses 71, 72 and 73 include radially opposing pairs of orifices 80 extending therethrough. Further in the depicted exemplary FIG. 6 embodiment, external grooves are provided in connection with the radially enlarged masses, with body 10*a* being received within the split bowstring 56 substantially along the length of body 10*a*.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. An archery bowstring accessory, comprising:

a unitary longitudinally elongated body comprising a head end portion, a tail end portion, and an intermediate section extending between the head end portion and the tail end portion; the intermediate section being configured to extend longitudinally along a bowstring in an orientation which configures the head end portion more proximate a limb end of a bow which receives said bowstring than is the tail end portion;

as so received, the head end portion constituting a speed increasing mass effective to impart increased arrow speed in an arrow shot by said bowstring of said bow than would otherwise occur in an identical arrow shot in the absence of the speed increasing mass; and as so received, the tail end portion constituting a vibration dampening mass effective to impart reduced bowstring vibration in said arrow shot than would otherwise occur in said identical arrow shot in the absence of said vibration dampening mass.

2. The archery bowstring accessory of claim 1 wherein the head end portion is radially enlarged as compared to the intermediate section.

3. The archery bowstring accessory of claim 1 wherein the tail end portion is radially enlarged as compared to the intermediate section.

4. The archery bowstring accessory of claim 1 wherein the head end portion and the tail end portion are radially enlarged as compared to the intermediate section.

5. The archery bowstring accessory of claim 1 wherein the head end portion and the tail end portion are radially enlarged to different degrees as compared to the intermediate section.

6. The archery bowstring accessory of claim 1 wherein the intermediate section has a substantially constant cross-sectional shape along at least a majority of its length.

7. The archery bowstring accessory of claim 6 wherein the substantially constant cross-sectional shape is that of a circle.

8. The archery accessory of claim 1 wherein the intermediate section does not have a substantially constant cross-sectional shape along a majority of its length.

9. The archery bowstring accessory of claim 1 wherein the intermediate section has a plurality of spaced, radially enlarged masses, extending along at least a portion of its length.

10. The archery bowstring accessory of claim 1 wherein the body is comprised of an elastomeric material.

11. The archery bowstring accessory of claim 1 wherein the body is comprised of an elastomeric material; and has an unstressed, unstretched, longest length of at least 4.0 inches.

12. The archery bowstring accessory of claim 1 wherein the body is comprised of an elastomeric material; and has an unstressed, unstretched, longest length of about 4.5 inches.

13. The archery bowstring accessory of claim 1 wherein the body is homogenous.

14. The archery bowstring accessory of claim 1 wherein the body is homogenous and comprises at least one orifice extending therethrough.

15. The archery bowstring accessory of claim 1 wherein the body is homogenous and comprises at least two orifices extending therethrough.

16. The archery bowstring accessory of claim 1 wherein the body comprises at least one orifice extending therethrough.

17. The archery bowstring accessory of claim 1 wherein the body comprises at least two orifices extending therethrough.

18. The archery bowstring accessory of claim 1 wherein the tail end portion comprises at least one orifice extending therethrough.

19. The archery bowstring accessory of claim 1 wherein the tail end portion comprises at least two orifices extending therethrough.

20. The archery bowstring accessory of claim 1 wherein the body is homogenous, and the tail end portion comprises at least one orifice extending therethrough.

21. The archery bowstring accessory of claim 1 wherein the body is homogenous, and the tail end portion comprises at least two orifices extending therethrough.

22. The archery bowstring accessory of claim 1 wherein the intermediate section comprises at least one orifice extending therethrough.

23. The archery bowstring accessory of claim 1 wherein the intermediate section comprises at least two orifices extending therethrough.

24. The archery bowstring accessory of claim 1 wherein the intermediate section comprises at plurality of radially opposing pairs of orifices extending therethrough.

25. The archery bowstring accessory of claim 1 wherein the tail end portion has a degree of flatness which is greater than any degree of flatness of the head end portion.

26. The archery bowstring accessory of claim 1 wherein the speed increasing mass is greater than the vibration dampening mass.

27. The archery bowstring accessory of claim 1 wherein the intermediate section has a mass which is less than each of the speed increasing mass and the vibration dampening mass.

28. The archery bowstring accessory of claim 1 wherein the speed increasing mass is greater than the vibration dampening mass, and the intermediate section has a mass which is less than each of the speed increasing mass and the vibration dampening mass.

29. The archery bowstring accessory of claim 1 wherein the head end portion comprises a pair of opposing external longitudinal grooves configured to receive respective portions of a split bowstring.

30. The archery bowstring accessory of claim 1 wherein the tail end portion comprises a pair of opposing external longitudinal grooves configured to receive respective portions of a split bowstring.

31. The archery bowstring accessory of claim 1 wherein the head end portion comprises a pair of opposing external longitudinal grooves configured to receive respective portions of a split bowstring, and wherein the tail end portion comprises a pair of opposing external longitudinal grooves configured to receive respective portions of said split bowstring.

32. The archery bowstring accessory of claim 1 wherein the tail end portion is angled from a general longitudinally elongated orientation of the body.

33. An archery bowstring accessory, comprising:

a homogenous unitary longitudinally elongated elastomeric body comprising a head end portion, a tail end portion, and an intermediate section extending between the head end portion and the tail end portion; the intermediate section being configured to extend longitudinally along a bowstring in an orientation which configures the head end portion more proximate a limb end of a bow which receives said bowstring than is the tail end portion;

as so received, the head end portion constituting a speed increasing mass effective to impart increased arrow speed in an arrow shot by said bowstring of said bow than would otherwise occur in an identical arrow shot in the absence of the speed increasing mass;

as so received, the tail end portion constituting a vibration dampening mass effective to impart reduced bowstring vibration in said arrow shot than would otherwise occur in said identical arrow shot in the absence of said vibration dampening mass;

the speed increasing mass being greater than the vibration dampening mass, the intermediate section having a mass which is less than each of the speed increasing mass and the vibration dampening mass; and the head end portion comprising a pair of opposing external longitudinal grooves configured to receive respective portions of a split bowstring, the tail head end portion comprising a pair of external opposing longitudinal grooves configured to receive respective portions of said split bowstring.

34. The archery bowstring accessory of claim 33 wherein the head end portion is radially enlarged as compared to the intermediate section.

35. The archery bowstring accessory of claim 33 wherein the tail end portion is radially enlarged as compared to the intermediate section.

36. The archery bowstring accessory of claim 33 wherein the intermediate section has a substantially constant cross-sectional shape along at least a majority of its length.

37. The archery bowstring accessory of claim 33 wherein the intermediate section does not have a substantially constant cross-sectional shape along a majority of its length.

38. The archery bowstring accessory of claim 33 wherein the body has an unstressed, unstretched, longest length of at least 4.0 inches.

39. The archery bowstring accessory of claim 33 wherein the body comprises at least one orifice extending therethrough.

40. The archery bowstring accessory of claim 33 wherein the body comprises at least two orifices extending therethrough.

41. The archery bowstring accessory of claim 33 wherein the tail end portion comprises at least one orifice extending therethrough.

42. The archery bowstring accessory of claim 33 wherein the tail end portion comprises at least two orifices extending therethrough.

43. The archery bowstring accessory of claim 33 wherein the intermediate section comprises at least one orifice extending therethrough.

44. The archery bowstring accessory of claim 33 wherein the intermediate section comprises at least two orifices extending therethrough.

45. The archery bowstring accessory of claim 33 wherein the tail end portion has a degree of flatness which is greater than any degree of flatness of the head end portion.

46. The archery bowstring accessory of claim 33 wherein the intermediate section has a mass which is less than each of the speed increasing mass and the vibration dampening mass.

47. The archery bowstring accessory of claim 33 wherein the speed increasing mass is greater than the vibration dampening mass, and the intermediate section has a mass which is less than each of the speed increasing mass and the vibration dampening mass.

48. The archery bowstring accessory of claim 33 wherein the tail end portion is angled from a general longitudinally elongated orientation of the body.

49. A method of increasing arrow speed and reducing bowstring vibration in shooting an arrow from an archery bow, comprising:

providing a unitary longitudinally elongated body comprising a head end portion, a tail end portion, and an intermediate section extending between the head end portion and the tail end portion;

securing the body to a bowstring operably received by an archery bow with the intermediate section extending longitudinally along and against the bowstring with the head end portion being received more proximate a limb end of the bow than is the tail end portion;

as so secured, the head end portion constituting a speed increasing mass effective to impart increased arrow speed in an arrow shot by said bowstring of said bow than would otherwise occur in an identical arrow shot in the absence of the speed increasing mass;

as so secured, the tail end portion constituting a vibration dampening mass effective to impart reduced bowstring vibration in said arrow shot than would otherwise occur in said identical arrow shot in the absence of said vibration dampening mass; and effecting said arrow shot having increased arrow speed and reduced bowstring vibration by shooting an arrow with said bow.

50. The method of claim 49 wherein the securing comprises wrapping the intermediate section longitudinally around the bowstring.

51. The method of claim 49 wherein the securing comprises wrapping the intermediate section longitudinally around the bowstring at least 5 times.

52. The method of claim 49 wherein the head end portion as so secured is received against the bowstring.

53. The method of claim 49 wherein the tail end portion as so secured is received against the bowstring.

54. The method of claim 49 wherein the head end portion as so secured is received against the bowstring, and wherein the tail end portion as so secured is received against the bowstring.

55. The method of claim 49 wherein the bowstring is splittable, and wherein the securing comprises positioning the head end portion within the split bowstring.

56. The method of claim 49 wherein the bowstring is splittable, and wherein the securing comprises positioning the tail end portion within the split bowstring.

57. The method of claim 49 wherein the bowstring is splittable, and wherein the securing comprises positioning the head end portion within the split bowstring and positioning the tail end portion within the split bowstring.

58. The method of claim 49 wherein the head end portion is radially enlarged as compared to the intermediate section.

59. The method of claim 49 wherein the tail end portion is radially enlarged as compared to the intermediate section.

60. The method of claim 49 wherein the head end portion and the tail end portion are radially enlarged as compared to the intermediate section.

61. The method of claim 49 wherein the intermediate section has a substantially constant cross-sectional shape along at least a majority of its length.

62. The method of claim 49 wherein the body is comprised of an elastomeric material, and the securing comprises retaining said body on the bowstring in a stretched state.

63. The method of claim 49 wherein the body is comprised of an elastomeric material; said body having an unstressed, unstretched, longest length of at least 4.0 inches; and the securing comprises retaining said body on the bowstring in a stretched state having a body length which is greater than is said unstressed, unstretched state.

64. The method of claim 49 wherein the body is comprised of an elastomeric material; said body having an unstressed, unstretched, longest length of at least 4.0 inches; and the securing comprises retaining said body on the bowstring in a stretched state having a body length less than 6 inches.

65. The method of claim 49 wherein the tail end portion has a degree of flatness which is greater than any degree of flatness of the head end portion.

66. The method of claim 49 wherein the speed increasing mass is greater than the vibration dampening mass.

67. The method of claim 49 wherein the intermediate section has a mass which is less than each of the speed increasing mass and the vibration dampening mass.

68. The method of claim 49 wherein the speed increasing mass is greater than the vibration dampening mass, and the intermediate section has a mass which is less than each of the speed increasing mass and the vibration dampening mass.

* * * * *